US011603301B2

(12) United States Patent
Luo

(10) Patent No.: US 11,603,301 B2
(45) Date of Patent: Mar. 14, 2023

(54) LIFTING MECHANISM AND LIFTING DEVICE WITH THE LIFTING MECHANISM

(71) Applicant: SUZHOU XINYOUHUA INVESTMENT ADVISOR CO., LTD., Suzhou (CN)

(72) Inventor: Tao Luo, Suzhou (CN)

(73) Assignee: SUZHOU XINYOUHUA INVESTMENT ADVISOR CO., LTD., Jiangsu (CN)

( * ) Notice: Subject to any disclaimer, the term of this patent is extended or adjusted under 35 U.S.C. 154(b) by 600 days.

(21) Appl. No.: 16/609,450

(22) PCT Filed: May 25, 2018

(86) PCT No.: PCT/CN2018/088339
§ 371 (c)(1),
(2) Date: Oct. 29, 2019

(87) PCT Pub. No.: WO2019/222990
PCT Pub. Date: Nov. 28, 2019

(65) Prior Publication Data

US 2020/0148520 A1 May 14, 2020

(30) Foreign Application Priority Data

May 23, 2018 (CN) ..... 201810502601.0

(51) Int. Cl.
*B66F 9/24* (2006.01)
*B66F 9/075* (2006.01)

(52) U.S. Cl.
CPC ..... *B66F 9/24* (2013.01); *B66F 9/0755* (2013.01); *B66F 9/07586* (2013.01)

(58) Field of Classification Search
CPC ..... B66F 9/24; B66F 9/0755; B66F 9/07568; B66F 9/07586; B66F 9/063
See application file for complete search history.

(56) References Cited

U.S. PATENT DOCUMENTS

2008/0166217 A1* 7/2008 Fontana ..... B66F 9/063 414/800
2014/0131542 A1* 5/2014 Hodnefield ..... B60N 2/509 248/419
2016/0214453 A1* 7/2016 Tanahashi ..... F16F 9/46

FOREIGN PATENT DOCUMENTS

CN 205170289 U 4/2016
CN 105598937 A 5/2016
(Continued)

OTHER PUBLICATIONS

DE102016107451A1 translate.*

*Primary Examiner* — Tyler J Lee
*Assistant Examiner* — Yufeng Zhang
(74) *Attorney, Agent, or Firm* — SZDC Law P.C.

(57) ABSTRACT

The present invention discloses a lifting mechanism mounted on a lifting device, wherein the lifting device includes a carrying unit. The lifting mechanism is disposed under the carrying unit, and comprises a driving assembly and a lifting assembly. The driving assembly includes an axle fixing part, a drive wheel and a power source, and the lifting assembly includes a screw nut and a screw rod. An upper end of the screw rod is fixedly connected to the carrying unit. When the lifting mechanism is traveling, each drive wheel is in contact with a base surface and moves the lifting device on the base surface; and when lifting, each drive wheel rotates on the base surface to drive the screw nut to rotate about a vertical axis relative to the carrying unit, to drive the screw rod to lift the carrying unit along the vertical direction.

8 Claims, 8 Drawing Sheets

(56) References Cited

FOREIGN PATENT DOCUMENTS

| | | | | | |
|---|---|---|---|---|---|
| CN | 106477257 | A | | 3/2017 | |
| CN | 206538142 | U | | 10/2017 | |
| CN | 304504358 | S | | 2/2018 | |
| JP | 2018162053 | A | * | 10/2018 | ..... B60G 13/00 |
| KR | 20180007721 | A | | 1/2018 | |

* cited by examiner

LIFTING MECHANISM AND LIFTING DEVICE WITH THE LIFTING MECHANISM

This application is the National Stage Application of PCT/CN2018/088339, filed on May 25, 2018, which claims priority to Chinese Patent Application No.: CN 201810502601.0, filed on May 23, 2018, which is incorporated by reference for all purposes as if fully set forth herein.

FIELD OF THE INVENTION

The invention relates to the technical field of lifting mechanisms, more particularly to a lifting mechanism and a lifting device with the lifting mechanism.

BACKGROUND OF THE INVENTION

Pallets play an important role in a workshop as a carrier. Currently the devices used to lift and transport pallets mainly comprise manual hydraulic trucks and electric or fuel forklifts. With the development of robot technology, a full autonomous navigation forklift for handling pallets has appeared, which can fork the pallets on the ground for the purpose of transporting; another kind of pallet handling robot can place the pallet on a pallet rack at a certain height, and the pallet handling robot goes below the pallet rack and lifts the pallet rack together with the pallet and transports it to a designated location.

The above-mentioned manual hydraulic trucks and electric or fuel forklifts are manually operated devices, which cannot meet the requirements of factory automation. The full autonomous navigation forklift is modified from a manned forklift. When the fork lifts the pallet, since the weight of the pallet is exerted on one side of the forklift (i.e. on the forks), a counter-weight has to be configured to the forklift, which causes that the weight and volume of the forklift are so large; or support wheels are provided under the fork, but the size and weight of the front part are large due to necessity of installing other parts such as a lifting mechanism, a drive mechanism and the like. And because of restriction of the volume and size, the drive mechanism can only be disposed on the front side of the forklift, so the forklift cannot complete spin turn and has a relatively large radius of turning circle.

For an autonomous navigation robot with a certain height, it is usually driven by two differential wheels or steering wheel, but such kind of robot is relatively high and cannot be inserted below the pallet like the forks of the forklift. So the pallet needs to be placed on the pallet rack at a height, so that the robot can go below the pallet rack, and then lift the pallet rack together with the pallet and transport it to a designated position. In the above-mentioned handling method, each pallet needs to be configured with a pallet rack, and the goods need to be placed on the pallet rack before lifting, which reduces the logistics efficiency, and increases the transportation cost.

SUMMARY OF THE INVENTION

To solve the above technical problems, an object of is to provide a lifting mechanism and a lifting device with the lifting mechanism, which enable multi-angle rotation of each drive wheel, and achieve travelling of a transport robot and lifting of a lifting mechanism under the action of the same drive assembly.

For the above purpose, the invention provides the following technical solutions.

In one aspect, the present invention provides a lifting mechanism, mounted on a lifting device which comprises a carrying unit, wherein the lifting mechanism is disposed under the carrying unit, and comprises a driving assembly and a lifting assembly, the driving assembly includes an axle fixing part, drive wheels disposed on the left and right sides of the axle fixing part, and a power source for driving the drive wheels, the lifting assembly includes a screw nut fixedly disposed on the axle fixing part, a screw rod extending in a vertical direction, and an upper end of the screw rod is fixedly connected to the carrying unit, and when the lifting mechanism is traveling, each drive wheel is in contact with a base surface and moves the lifting device on the base surface; when lifting, each drive wheel rotates on the base surface to drive the screw nut to rotate about a vertical axis relative to the carrying unit, to drive the screw rod to lift the carrying unit along the vertical direction.

Preferably, the power source comprises drive motors disposed at front and rear sides of the axle fixing part for driving the drive wheels, and a motor driver communicated with the drive motors is provided on the axle fixing part.

Preferably, the lifting mechanism comprises a conductive slip ring for measuring an absolute rotation angle of the screw rod, and the conductive slip ring is communicated with the drive motor.

Preferably, the conductive slip ring comprises a lower half that is sleeved and fixedly disposed relative to the screw nut, and an upper half that is sleeved on the screw rod, and the upper half is rotatably coupled to the lower half to measure the absolute rotation angle of the screw rod.

In another aspect, the invention also provides a lifting device, which comprises a carrying unit, and further comprises the lifting mechanisms which are mounted under the carrying unit in parallel.

Preferably, the lifting device further comprises a flexible adjusting unit disposed under the carrying unit, the carrying unit comprises a first housing a second housing disposed in parallel, and a connecting plate that connects front ends of the first housing and the second housing, wherein the flexible adjusting unit flexibly connects the first housing and the second housing to the connecting plate respectively to drive the drive wheels to abut against the ground surface.

Preferably, the flexible adjusting unit comprises a linear guide shaft extending in a vertical direction, a mounting part and a compression spring respectively sleeved on the linear guide shaft, the upper end of the linear guide shaft is fixedly connected to the connecting plate, a lower baffle is fixedly provided on a lower end of the linear guide shaft, and the mounting part is fixedly connected to the first housing or the second housing, an upper end of the compression spring abuts the mounting part, and the lower end abuts the lower baffle, the first housing or the second housing drives the mounting part to move vertically relative to the connecting plate, such that the spring is compressed to drive the drive wheels to abut against the ground surface.

Preferably, a joint ball bearing for connecting the mounting part and the linear guide shaft is provided therebetween, and an axis of the joint ball bearing is collinear with an axis of the linear guide shaft, a lubrication guide sleeve for connecting the mounting part and the linear guide shaft is provided therebetween, and an axis of the lubrication guide sleeve is collinear with an axis of the linear guide shaft.

Preferably, a distance measuring sensor is provided on the inner side of the second housing for maintaining a constant distance between the first housing and the second housing, and a synchronous communication sensor is provided on the inner side of each of the first housing and the second housing for ensuring the synchronous operation of the drive wheels.

Preferably, the first housing, the second housing and the connecting plate are provided with a plurality of anti-collision sensors and safety sensors, and a vision sensor is provided on a lower side of each of the first housing and the second housing for detecting the ground to position the drive assembly.

By means of the above technical solutions, the present invention has at least the following advantages:

1. The invention provides a lifting mechanism including a driving assembly and a lifting assembly, the traveling of the transport robot, and the lifting and lowering actions of the lifting mechanism are achieved under the action of the same driving assembly, no additional separate driving mechanisms are needed to achieve the above actions, and thus the overall structure is optimized;

2. In order to prevent that all of the drive wheels of the transport robot cannot touch the ground at the same time since the first housing and the second housing are fixedly connected, a flexible adjusting unit is provided to couple the first housing and the second housing together in parallel, and when the transport robot is crossing uneven ground, at the lower side of the transport robot, the compression spring is compressed due to the weight, thus the lower side of the transport robot moves down so that the drive wheel on the side can touch the ground.

wherein: 1, lifting mechanism; 2, flexible adjusting unit; 3, first housing; 4, second housing; 5, connecting plate; 6, distance measuring sensor; 7, synchronous communication sensor; 8, anti-collision sensor; 9, safety sensor; 10, vision sensor; 101, axle fixing part; 102, drive wheel; 103, screw nut; 104, screw rod; 105, drive motor; 106, motor driver; 107*a*, lower half; 107*b*, upper half; 201, linear guide shaft; 202, mounting part; 203, compression spring; 204, lower baffle; 205, joint ball bearing; 206, lubrication guide sleeve.

DETAILED DESCRIPTION OF THE EMBODIMENTS

The invention will be further illustrated in more detail with reference to the accompanying drawings and embodiments. It is noted that, the following embodiments only are intended for purposes of illustration, but are not intended to limit the scope of the present invention.

Figure 1:
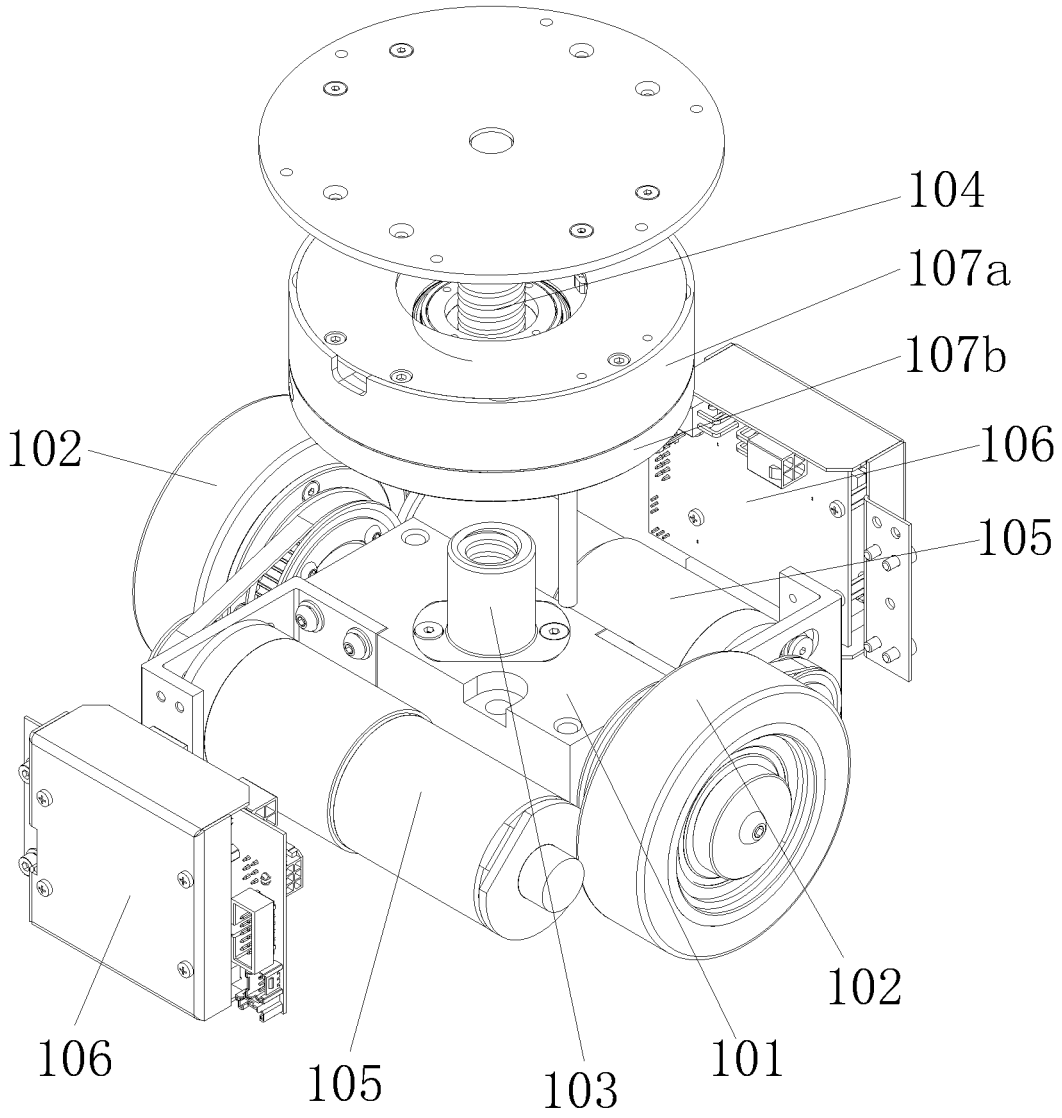
FIG. 1 is an exploded view of a lifting mechanism of the present invention.

With reference to FIG. 1, the present invention discloses a lifting mechanism mounted on a lifting device, and in the present invention, preferably, the lifting device is a transport robot. The transport robot includes a carrying unit, a lifting mechanism 1 which is disposed under the carrying unit and abuts against the carrying unit. The lifting mechanism 1 includes a driving assembly and a lifting assembly, and the lifting mechanism can achieve lifting and driving functions by the same driving assembly. The driving assembly includes an axle fixing part 101, drive wheels 102 disposed on the left and right sides of the axle fixing part 101, and a power source for driving the drive wheels 102. In the present invention, the power source comprises drive motors 105 disposed at front and rear sides of the axle fixing part 101 for driving the drive wheels 102 respectively, and a motor driver 106 communicating with the drive motor 105 is provided on the axle fixing part 101. With the above arrangement, the traveling of the lifting mechanism can be accurately controlled. In the present invention, preferably, the output shaft of the drive motor 105 is provided with a small synchronous pulley, and a big synchronous pulley and a belt connecting the small synchronous pulley with the big synchronous pulley are provided on one side of the drive wheel 102. With the above arrangement, the driving force of the drive motor 105 is effectively transmitted to the drive wheels 102, and the structure is optimized and compact. The lifting assembly includes a screw nut 103 disposed on the axle fixing part 101 and a screw rod 104 extending in a vertical direction. Preferably, a support plate for the screw rod is provided on the upper end of the screw rod 104, and the support plate is fixedly connected to the carrying unit.

When the lifting mechanism is traveling, each of the drive wheels 102 contacts the base surface and moves the lifting device on the base surface; specifically, the output shafts of the two drive motors 105 drive the small synchronous pulley to rotate, and the driving force is transmitted to the big synchronous pulley through the synchronous belt, thereby driving the drive wheels 102 to rotate and realizing the traveling of the transport robot. When the lifting mechanism is lifting, each of the drive wheels 102 rotates on the base surface to drive the rotation of the screw nut 103 about a vertical axis relative to the carrying unit, to drive the screw rod 104 to move vertically to lift the carrying unit. Specifically, the carrying unit applies a bearing force to the lifting mechanism, and at the same time, the two drive wheels 102 rotate only about the vertical axis, and the forces are offset, under the action of the screw rod 104 and the screw nut 103, it is ensured that the carrying unit only moves in the vertical direction relative to the lifting mechanism. The two drive wheels 102 rotate 360° (clockwise or counterclockwise) synchronously about the vertical axis, to drive the screw nut 103 to rotate and thus the driving screw 104 moves in the vertical direction, in this way, the carrying unit achieves the lifting and lowering motions in the vertical direction.

The lifting and lowering motions of the lifting mechanism are realized by the threaded connection between the screw rod 104 and the screw nut 103 in cooperation with the in-situ rotation of the drive wheels 102, and the number of turns of the drive assembly is needed to be controlled accurately to meet different lifting demands. Preferably, the lifting mechanism comprises a conductive slip ring for measuring an absolute rotation angle of the screw rod 104, and the conductive slip ring is communicated with the drive motor 105. The conductive slip ring includes a lower half 107*b* that is sleeved and fixedly arranged to the screw nut, and an upper half 107*a* that is sleeved on the screw rod 104. The upper half 107*a* is rotatably coupled to the lower half 107*b* to measure the absolute rotation angle of the screw rod 104 (an absolute rotation angle of the screw nut 103 relative to the screw rod 104, i.e., the rotation angle of the two drive wheels 102 about the vertical axis). In this way, the lower half 107*b* of the conductive slip ring can rotate with the axle fixing part 101, and at the same time, it is ensured that the upper half 107*a* of the conductive slip ring moves in the vertical direction with the screw rod 104, and thus the rotation angle and number of turns of the driving assembly can be measured accurately.

Referring to FIGS. 1 to 8, the present invention discloses a lifting device, which is preferably a transport robot, including a carrying unit and parallel lifting mechanisms, and the parallel lifting mechanisms are mounted under the carrying unit. The carrying unit includes a first housing 3 and a second housing 4 disposed in parallel, and a connecting plate 5 which connects the front ends of the first housing 3 and the second housing 4. In an embodiment, preferably, the carrying unit is U-shaped, wherein the first housing 3 and the second housing 4 correspond to the two forks of a forklift, ensuring that the first housing 3 and the second housing 4 can be inserted under the object to be lifted (the object can be a pallet or a pallet loaded with the goods), there is no need to configure a counterweight like the forklift in prior art, and there is no need to customize a pallet rack like a lowerable autonomous navigation robot with a certain height, thereby significantly improving the efficiency of the handling process and reducing the cost. The lifting mechanism further comprises a flexible adjusting unit 2 disposed under the carrying unit, wherein the flexible adjusting unit 2 flexibly connects the first housing 3 and the second housing 4 to the connecting plate 5 respectively, to drive the drive wheels 102 to abut against the ground surface.

Figure 2:
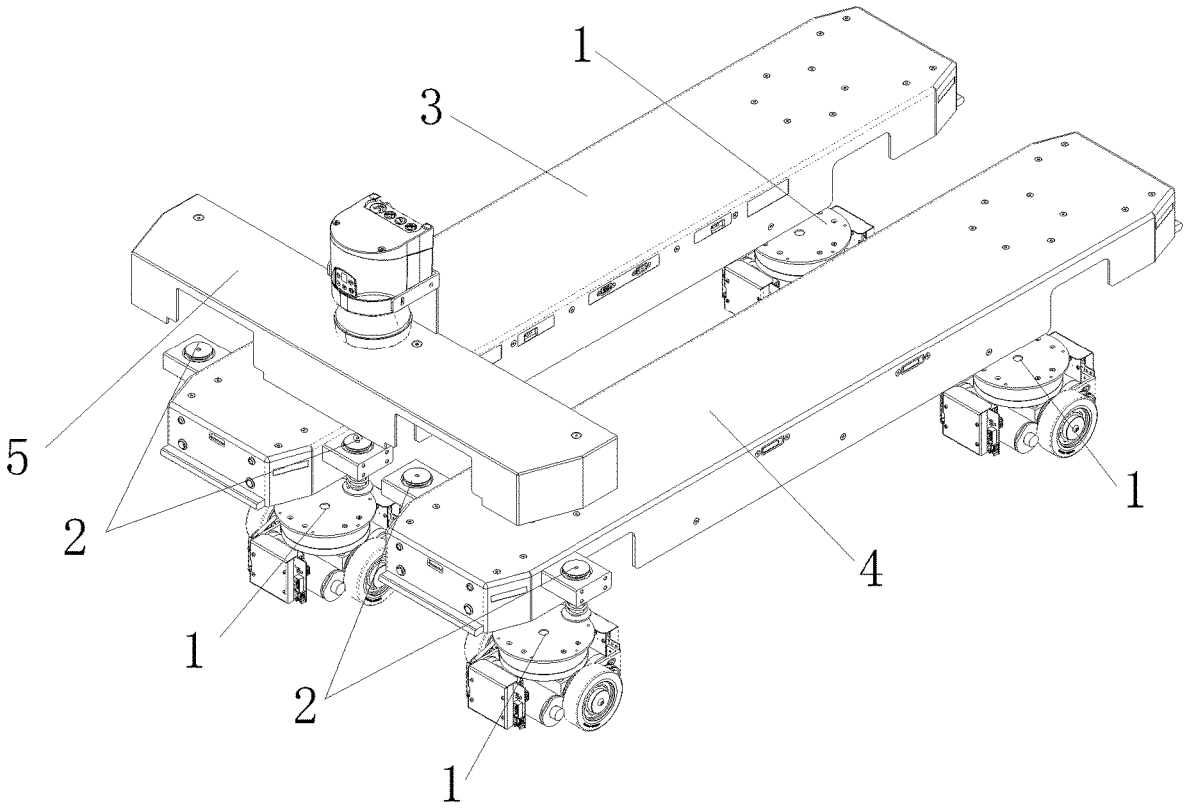
FIG. 2 is a schematic view showing the overall structure of a lifting device of the present invention.
Figure 3:
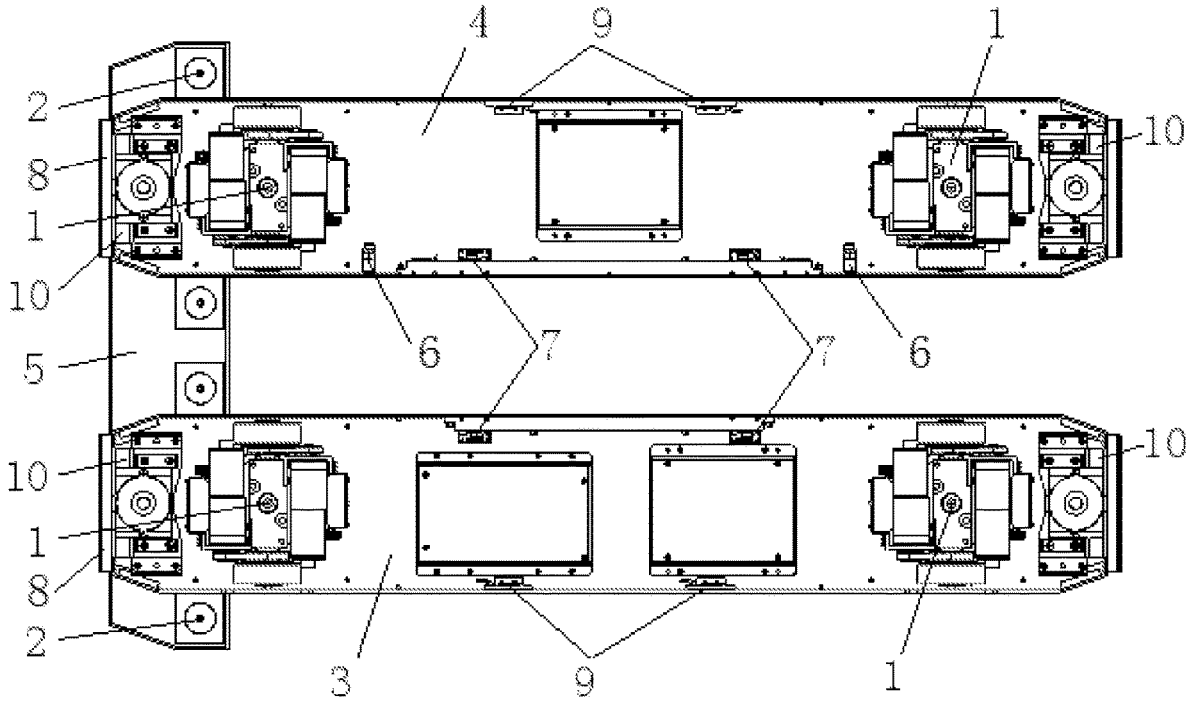
FIG. 3 is a bottom view showing the overall structure of the lifting device of the present invention.
Figure 4:
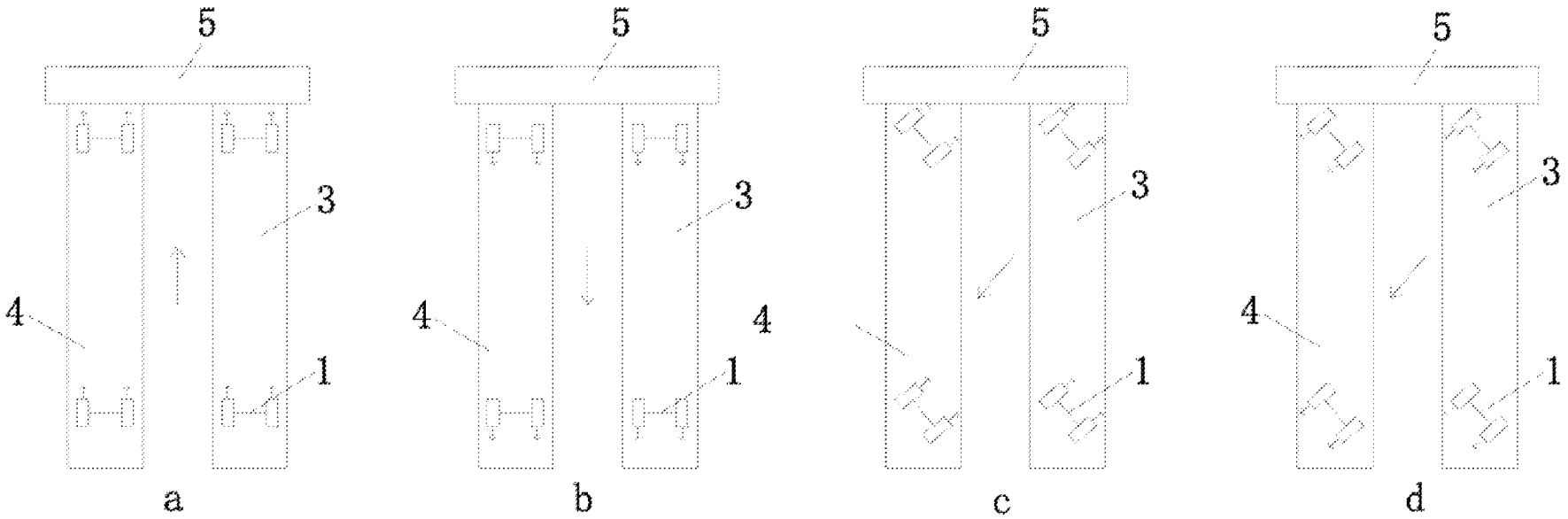
FIG. 4 is a schematic view showing the forward, backward and oblique movement of the lifting device of the present invention.
Figure 5:
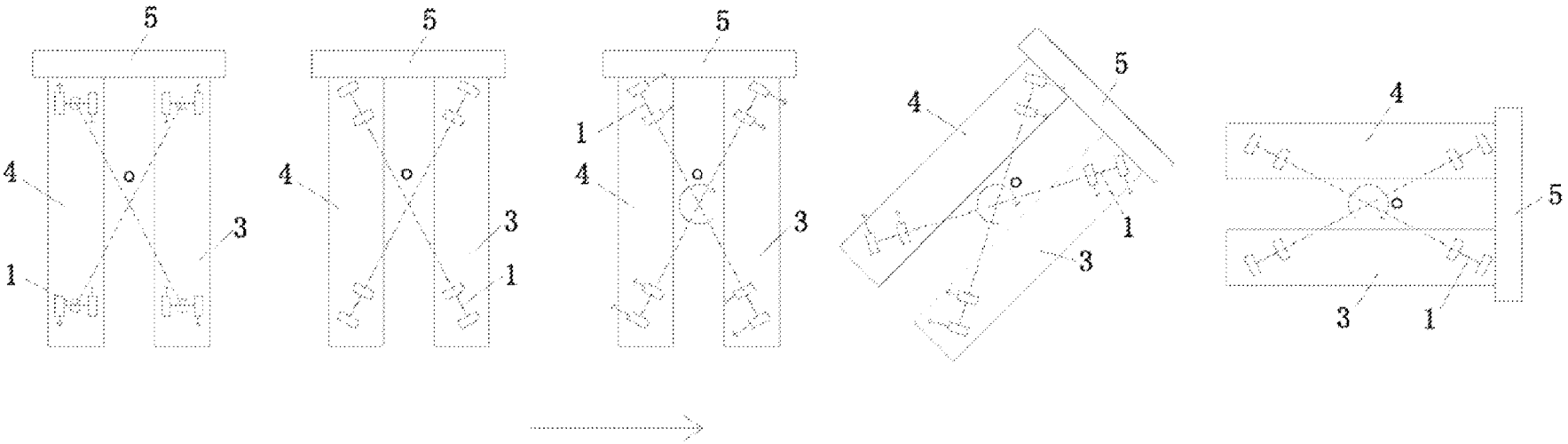
FIG. 5 is a schematic view showing the spin turn of the lifting device of the present invention.
Figure 6:
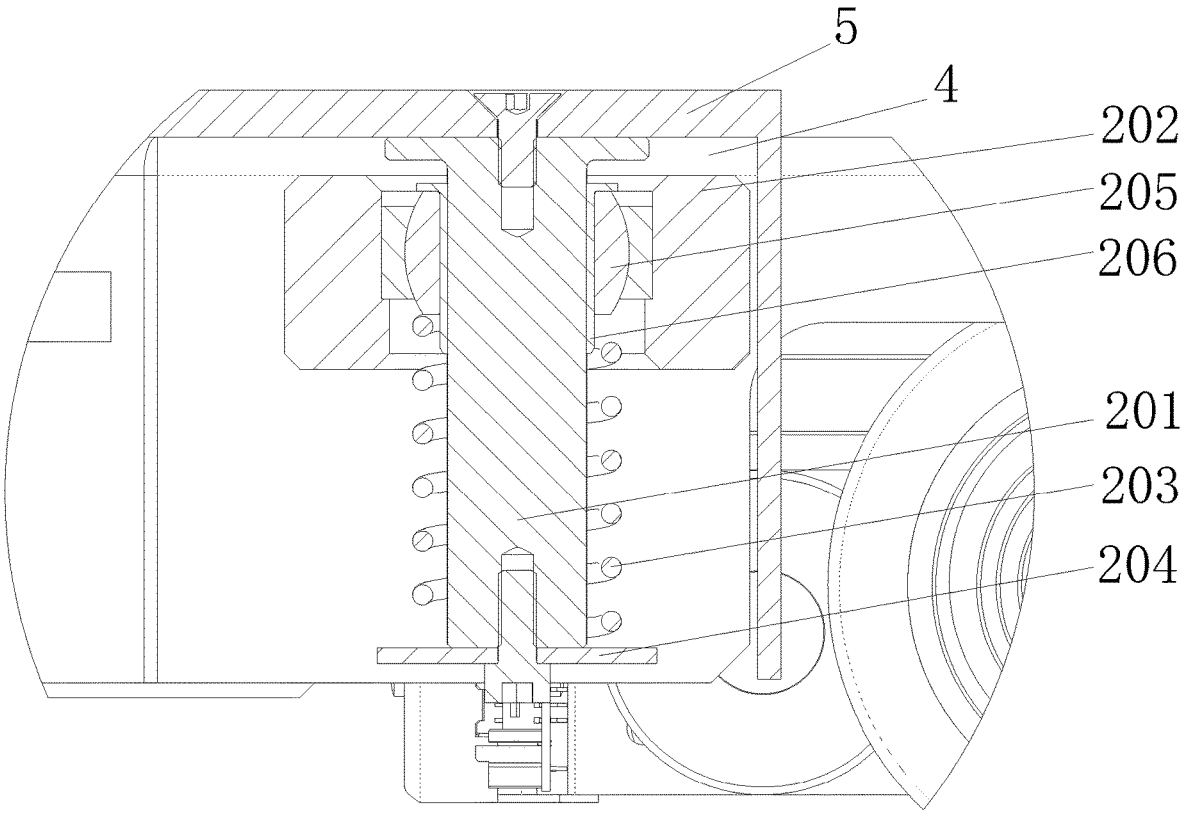
FIG. 6 is a schematic view of a flexible adjusting unit of the present invention.

As shown in FIG. 2, the transport robot in the embodiment is provided with four sets of lifting mechanisms. Preferably, two lifting mechanisms 1 are disposed under the first housing 3 and the second housing 4 respectively. In this way, there are eight drive wheels 102 in contact with the base surface to move the transport robot on the base surface. Specifically, as shown in FIG. 4, a and b indicate the forward/backward action of the transport robot: each of the drive wheels 102 is located on the axis in the front-rear direction, the drive motor 105 is controlled such that the drive wheels 102 work simultaneously, thereby enabling the transport robot to move forward and backward. FIG. 5 shows the turning action of the transport robot: firstly, the two sets of drive assemblies at the same side are controlled to run in opposite directions, each drive assembly is rotated at an angle about the vertical axis, such that two lines respectively connecting two driving assemblies on different sides (on virtual diagonal lines) intersect at a point O, the transport robot makes an in-situ turn around the point O by synchronously controlling the drive wheels (it is ensured that all the drive wheels 102 rotate about the point O at a same angular velocity, the four drive wheels 102 near the point O have different speed from the four derive wheels 102 away from the point O). As shown in FIG. 4, c and d indicate the straight motion of the transport robot in any direction: the two drive assemblies at the same side are controlled to move in the same direction, such that each drive assembly rotates at an angle about the vertical axis, and the transport robot can go straight in any direction by controlling the actions of the drive wheels 102 synchronously, Controlling the drive wheels 102 to rotate a certain angle enables to go straight in different directions.

The flexible adjusting unit 2 in an embodiment includes a linear guide shaft 201 extending in the vertical direction, a mounting part 202 and a compression spring 203 that are sleeved on the linear guide shaft 201 respectively, the mounting part 202 is movable in the vertical direction relative to the linear guide shaft 201. The upper end of the linear guide shaft 201 is fixedly connected to the connecting plate 5, and the lower end is fixedly provided with a lower baffle 204. The mounting part 202 is fixedly connected to the first housing 3 or the second housing 4, and the upper end of the compression spring 203 abuts against the mounting part 202, and the lower end abuts against the lower baffle 204. By means of the flexible adjusting unit 2, when the transport robot is running on an uneven ground, in order to prevent that not all the drive wheels 102 of the transport robot are in contact with the ground at the same time since the first housing 3 and the second housing 4 are connected rigidly, the first housing 3 and the second housing 4 are connected in parallel to form a parallel structure. When the ground surface is uneven, on the lower side of the transport robot, the mounting part 202 are forced to move downward along the linear guide shaft 201 due to the self-weight of the first housing 3 or the second housing 4 and the lifting mechanism, thus the compression spring 203 is compressed and the overall driving assembly is moved downward, so that the lower side of the transport robot moves downward and the drive wheels 102 on this side can be in touch with the ground surface, thereby avoiding idling of the drive wheels 102 and the positioning accuracy will not be affected.

Figure 7:
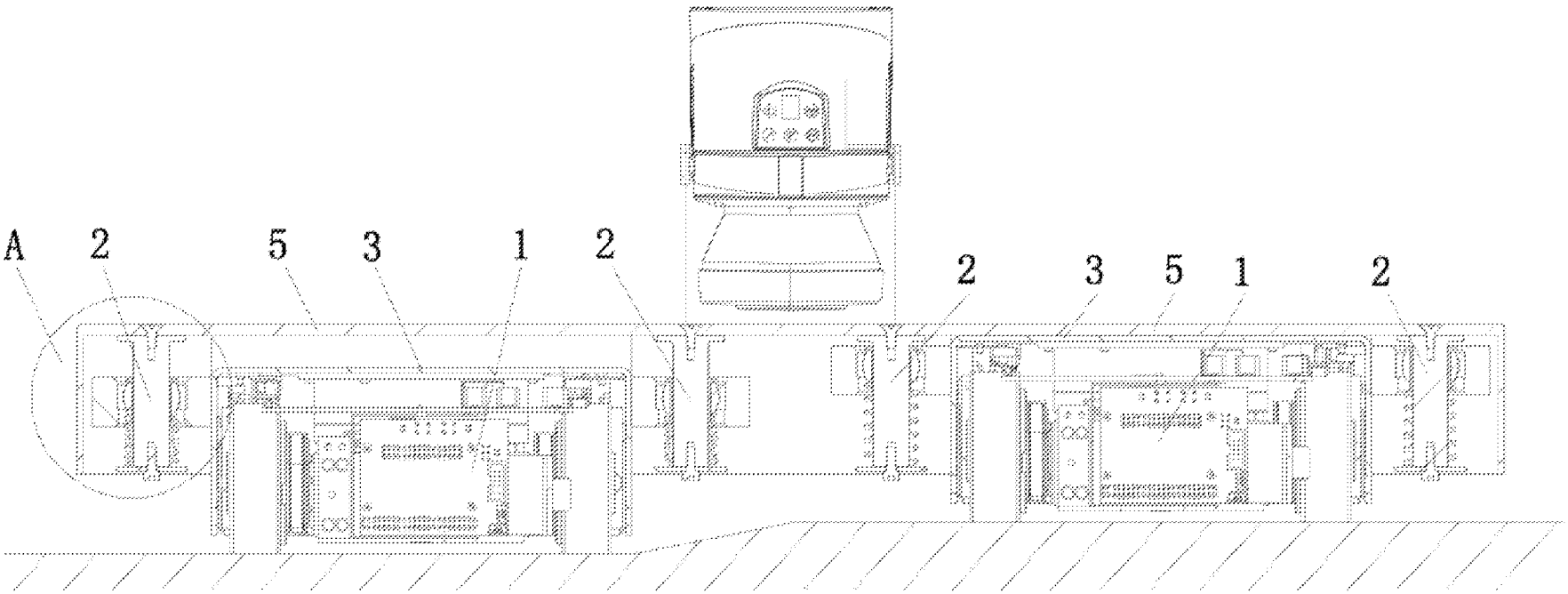
FIG. 7 is a front cross-sectional view of the lifting device of the present invention when it is located on uneven ground.
Figure 8:
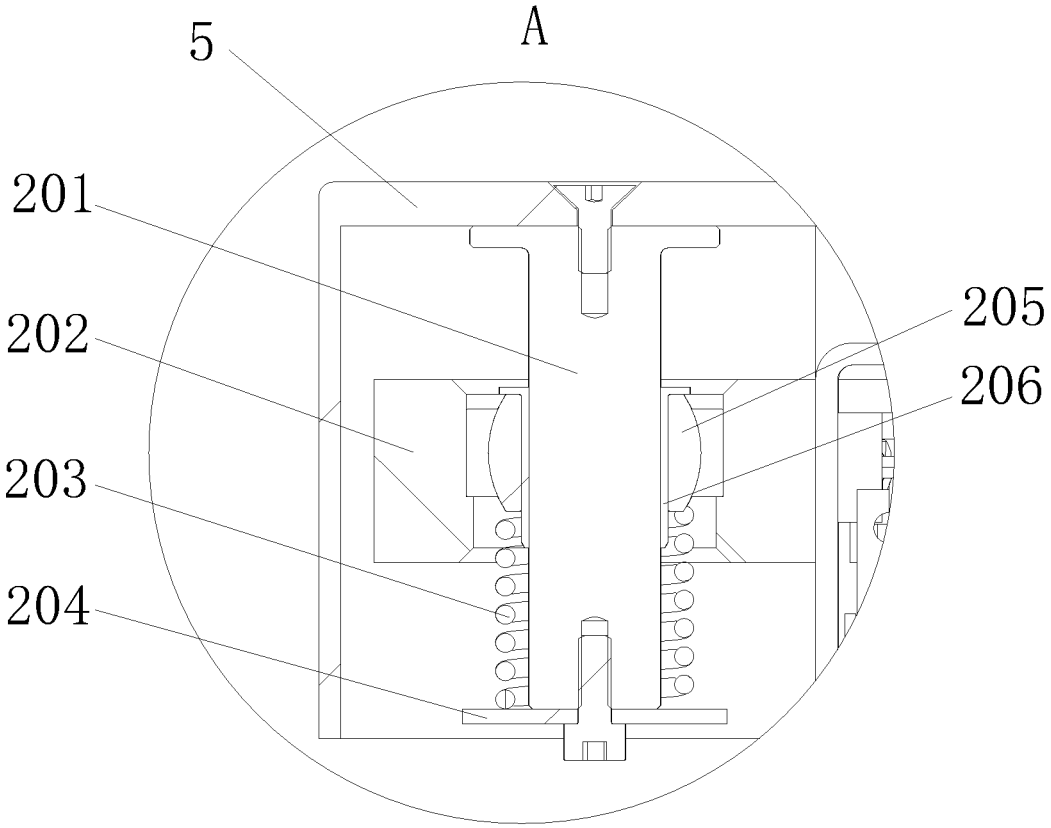
FIG. 8 is an enlarged view of the flexible adjusting unit at A in FIG. 7.

Specifically, as shown in FIG. 7, when the transport robot is running on an uneven ground, taking the higher side of the transport robot as reference (assuming that the first housing is on the higher side), the first housing 3 abuts the connecting plate 5 closely, the mounting part 202 are forced to move downward relative to the connecting plate 5 due to the self-weight of the second housing 4 and the lifting mechanism at the same side, the relative displacement is formed and the compression spring 203 is compressed and the second housing 4 moves downward with the lifting mechanism at the same side, until the drive wheels 102 of the lifting mechanism is in touch with the ground surface, where, the compression spring 203 will be compressed no longer since the lifting mechanism and the second housing 4 are rigidly connected. Since the lower end of the compression spring 203 abuts against the lower baffle 204, the position of the mounting part 202 is also limited.

Preferably, a joint ball bearing 205 is provided for connecting the mounting part 202 and the linear guide shaft 201 therebetween, and the axis of the joint ball bearing 205 is collinear with the axis of the linear guide shaft 201. In this way, the requirements on the vertical precision and the mounting accuracy of the linear guide shaft 201 can be reduced, and by means of the joint ball bearing 205, when the transport robot is slightly inclined, the joint ball bearing 205 pivots to make compensation and eliminates the effect of inclination on the drive wheels 102. A lubrication guide sleeve 206 for connecting the mounting part 202 and the linear guide shaft 201 is disposed therebetween, and the axis of the lubrication guide sleeve 206 is collinear with the axis of the linear guide shaft 201, and the lubrication guide sleeve 206 is disposed in the inner ring of the joint ball bearing 205. By means of the lubricating guide sleeve 206, dry friction between the linear guide shaft 201 and the joint ball bearing 205 is avoided, and the service life of both is improved.

In an embodiment, the connecting plate 5 is provided with a navigation laser to realize the full autonomous navigation function of the transportation navigation robot. Since the transport robot may run in any direction, it is required to ensure safety during operation, and thus the first housing 3, the second housing 4 and the connecting plate 5 are provided with a plurality of anti-collision sensors 8 and safety sensors 9. Preferably, the anti-collision sensors 8 and the safety sensors 9 are arranged at the front, rear, left, and right sides of the lifting device, which effectively ensures the safety of the transport robot during operation. A vision sensor 10 is provided on the lower side of each of the first housing 3 and the second housing 4 for detecting the position of the ground and positioning the driving assembly. Preferably, the vision sensor 10 is provided with a charging chip, which is electrically connected to the vision sensor 10 for autonomous charging of the vision sensor 10. By means of the assistant positioning based on ground, the vision sensor 10 feeds back signals to the control unit, and the control unit controls the movement of the transport robot by controlling the movement of the first housing 3 and the second housing 4, thereby realizing accurate positioning of the robot.

A distance measuring sensor 6 is provided on the inner side of the second housing 4 for maintaining the distance between the second housing 4 and the first housing 3. Taking the first housing 3 as reference, the motion state of the second housing 4 is adjusted in real time to ensure that the distance between the first housing 3 and the second housing 4 is constant, and the connecting plate 5 will not be deformed. A synchronous communication sensor 7 is provided on the inner side of each of the first housing 3 and the second housing 4 for ensuring synchronous operation of the drive wheels 102, such that the first housing 3 and the second housing 4 are synchronized and the state of operation can be received with each other. When the synchronization is not achieved, the signal can be fed back to the control unit through the synchronous communication sensor 7, and the control unit makes adjustment so that the second housing 4 is synchronized with the first housing 3. In this way, the synchronization and constant distance between the first housing 3 and the second housing 4 are ensured.

The above description is only preferred embodiments of the present invention and not intended to limit the present invention, it should be noted that those of ordinary skill in the art can further make various modifications and variations without departing from the technical principles of the present invention, and these modifications and variations also should be considered to be within the scope of protection of the present invention.

The invention claimed is:

1. A lifting device comprising:

a carrying unit, and a plurality of lifting mechanism, wherein the lifting mechanisms are mounted under the carrying unit in parallel;

wherein each of the lifting mechanisms comprises:

a driving assembly, the driving assembly including an axle fixing part, drive wheels disposed on the left and right sides of the axle fixing part, and a power source for driving the drive wheels, and a lifting assembly, the lifting assembly including a screw nut fixedly disposed on the axle fixing part, a screw rod extending in a vertical direction, and an upper end of the screw rod being fixedly connected to the carrying unit;

when the each lifting mechanism is traveling, each drive wheel is in contact with a base surface and moves the lifting device on the base surface; and when lifting, each drive wheel rotates on the base surface to drive the screw nut to rotate about a vertical axis relative to the carrying unit, to drive the screw rod to lift the carrying unit along the vertical direction; and wherein the lifting device further comprises a flexible adjusting unit disposed under the carrying unit, the carrying unit comprises a first housing and a second housing disposed in parallel, and a connecting plate that connects front ends of the first housing and the second housing, wherein the flexible adjusting unit flexibly connects the first housing and the second housing to the connecting plate respectively to drive the drive wheels to abut against the ground surface.

2. The lifting device as claimed in claim 1, wherein the power source comprises drive motors disposed at front and rear sides of the axle fixing part for driving the drive wheels, and a motor driver communicated with the drive motors is provided on the axle fixing part.

3. The lifting device as claimed in claim 2, wherein the each lifting mechanism comprises a conductive slip ring for measuring an absolute rotation angle of the screw rod, and the conductive slip ring is communicated with the drive motor.

4. The lifting device as claimed in claim 3, wherein, the conductive slip ring comprises a lower half that is sleeved and fixedly disposed relative to the screw nut, and an upper half that is sleeved on the screw rod, and the upper half is rotatably coupled to the lower half to measure the absolute rotation angle of the screw rod.

5. The lifting device as claimed in claim 1, wherein the flexible adjusting unit comprises a linear guide shaft extending in a vertical direction, a mounting part and a compression spring respectively sleeved on the linear guide shaft, the connecting plate is fixedly connected to an upper end of the linear guide shaft, a lower baffle is fixedly provided on a lower end of the linear guide shaft, and the mounting part is fixedly connected to the first housing or the second housing, an upper end of the compression spring abuts the mounting part, and the lower end abuts the lower baffle, the first housing or the second housing drives the mounting part to move vertically relative to the connecting plate, such that the spring is compressed to drive the drive wheels to abut against the ground surface.

6. The lifting device as claimed in claim 5, wherein a joint ball bearing for connecting the mounting part and the linear guide shaft is provided therebetween, and an axis of the joint ball bearing is collinear with an axis of the linear guide shaft, a lubrication guide sleeve for connecting the mounting part and the linear guide shaft is provided therebetween, and an axis of the lubrication guide sleeve is collinear with an axis of the linear guide shaft.

7. The lifting device as claimed in claim 5, wherein a distance measuring sensor is provided on the inner side of the second housing for maintaining a constant distance between the first housing and the second housing, and a synchronous communication sensor is provided on the inner side of each of the first housing and the second housing for ensuring the synchronous operation of the drive wheels.

8. The lifting device as claimed in claim 5, wherein the first housing, the second housing and the connecting plate are provided with a plurality of anti-collision sensors and safety sensors, and a vision sensor is provided on a lower side of each of the first housing and the second housing for detecting the ground to position the drive assembly.

* * * * *